US008410388B2

(12) United States Patent
Kriegel et al.

(10) Patent No.: US 8,410,388 B2
(45) Date of Patent: Apr. 2, 2013

(54) SELF-BLOWOUT CIRCUIT BREAKER HAVING A FILLING AND OVERPRESSURE VALVE

(75) Inventors: Martin Kriegel, Ehrendingen (CH); Daniel Ohlsson, Niederrohrdorf (CH); Juerg Nufer, Niederglatt (CH); Navid Mahdizadeh, Baden (CH); Olaf Hunger, Schaffhausen (CH); Timo Kehr, Birrhard (CH)

(73) Assignee: ABB Technology AG, Zurich (CH)

( * ) Notice: Subject to any disclaimer, the term of this patent is extended or adjusted under 35 U.S.C. 154(b) by 136 days.

(21) Appl. No.: 12/881,735

(22) Filed: Sep. 14, 2010

(65) Prior Publication Data

US 2011/0062116 A1 Mar. 17, 2011

(30) Foreign Application Priority Data

Sep. 17, 2009 (EP) ..... 09170549

(51) Int. Cl.
*H01H 33/86* (2006.01)

(52) U.S. Cl. ..... 218/66; 218/109; 218/35; 218/51

(58) Field of Classification Search ..... 218/66, 218/109, 35, 51
See application file for complete search history.

(56) References Cited

U.S. PATENT DOCUMENTS 3,940,583 A 2/1976 Hertz
5,561,280 A * 10/1996 Blatter ..... 218/59
5,589,673 A * 12/1996 Lehmann et al. ..... 218/66
5,977,502 A * 11/1999 Mizoguchi et al. ..... 218/43
6,807,892 B2 * 10/2004 Biegelsen et al. ..... 91/459
2009/0261071 A1 10/2009 Nufer et al.

FOREIGN PATENT DOCUMENTS

DE 2 316 009 A1 10/1974
DE 41 07 673 A1 9/1992
DE 42 11 159 A1 10/1993
EP 1 939 910 A1 7/2008

OTHER PUBLICATIONS

European Search Report dated Feb. 2, 2010 (with English language translation of category of cited documents).

* cited by examiner

*Primary Examiner* — Truc Nguyen

(74) *Attorney, Agent, or Firm* — Buchanan Ingersoll & Rooney PC

(57) ABSTRACT

A self-blowout circuit breaker is disclosed which includes contacts for connecting or disconnecting a circuit, a heating volume, a compression volume and an exhaust volume. The compression volume can be connected to the heating volume by at least one first valve, which heating volume is in turn connected to an arc zone. Upon the disconnection of the circuit, while a first arcing contact is being disconnected from an associated second arcing contact, an arc is produced between the two arcing contacts in the arc zone. The compression volume is separated from the exhaust volume by a combined filling and overpressure valve which is formed as at least one plate, and has at least one tab which is formed in the plate.

14 Claims, 4 Drawing Sheets

SELF-BLOWOUT CIRCUIT BREAKER HAVING A FILLING AND OVERPRESSURE VALVE

RELATED APPLICATION

This application claims priority under 35 U.S.C. §119 to European Patent Application No. 09170549.1 filed in Europe on Sep. 17, 2009, the entire content of which is hereby incorporated by reference in its entirety.

FIELD

The present disclosure is directed to medium-voltage and high-voltage technology, and to circuit breakers used, for example in power distribution networks.

BACKGROUND INFORMATION

Self-blowout or self-extinguishing circuit breakers (also called gas-blast circuit breakers) are used, for example, in high-voltage technology. Self-blowout circuit breakers are designed in such a manner that, in the event of the contacts being disconnected or in the event of a short circuit, a resultant arc is blasted with a gas and is thereby quenched as quickly as possible. The most widely used gas for this purpose is $SF_6$ (sulfur hexafluoride).

European patent application EP 1939910 A1 discloses a gas-blast circuit breaker having a plurality of contacts which can be moved relative to one another. A blowing volume which is connected to an arc zone via a blowing channel is arranged around a first contact. The blowing volume is separated from a low-pressure space by a separating element. A throughflow opening which is used to exchange gas between the blowing volume and the low-pressure space is provided in the separating element.

U.S. Pat. No. 5,589,673 discloses a self-blowout circuit breaker in which a pressure chamber, in which the arc is produced, is connected under the control of a valve to a compression space. The compression space is connected to a low-pressure space via an overpressure valve and a top-up valve or filling valve. The valves are annular and are arranged such that they rest against one another with an overlapping zone. On the side of the low-pressure space, the overpressure valve is pressed against a valve holder in the direction of the compression volume by a spring. Gas can therefore flow from the compression volume into the low-pressure space only when its pressure is greater than the spring force. This design is relatively complicated and involves a large number of elements.

SUMMARY

A self-blowout circuit breaker is disclosed having contacts for connecting or disconnecting a circuit, the self-blowout circuit breaker comprising: at least one first arcing contact and one first rated current contact moveable back and forth in a direction of a longitudinal axis of the self-blowout circuit breaker; a compression volume which is connected to a heating volume by at least one non-return valve, which heating volume is connected to an arc zone, such that when the first arcing contact is being disconnected from at least one associated second arcing contact, an arc is produced between the first and second arcing contacts in the arc zone; and an exhaust volume, wherein the compression volume and the exhaust volume are filled with a gas, the compression volume being separated from the exhaust volume by a combined filling and overpressure valve formed by at least one plate having at least one tab formed in the plate.

BRIEF DESCRIPTION OF THE DRAWINGS

Further refinements, advantages and uses of features as disclosed herein will become apparent from the description which follows with reference to the Figures, in which.

Reference symbols used in the figures and their meaning are listed in summarized form in the list of reference symbols. Parts which are not essential to understanding the disclosed embodiments are not illustrated. The embodiments described are examples of the subject matter disclosed herein and do not have a restrictive effect, rather the disclosure can be implemented in any suitable manner within the scope of the patent claims.

DETAILED DESCRIPTION

Self-blowout circuit breakers are disclosed wherein a number of components involved can be reduced relative to known devices.

An exemplary self-blowout circuit breaker has contacts for connecting or disconnecting a circuit. At least one first arcing contact and one first rated current contact can be moved back and forth in the direction of the longitudinal axis of the self-blowout circuit breaker. An exemplary self-blowout circuit breaker as disclosed herein also has a compression volume and an exhaust volume which are filled with a gas. The compression volume is connected to a heating volume by at least one first valve. The heating volume is in turn connected to an arc zone. Upon the disconnection of the circuit, while the first arcing contact is being disconnected from at least one associated second arcing contact, an arc is produced between the two arcing contacts in the arc zone.

The compression volume can be separated from the exhaust volume by a combined filling and overpressure valve which is, for example, in the form of at least one plate. The filling and overpressure valve can have at least one tab or flap, which is formed in the plate.

An exemplary self-blowout circuit breaker as disclosed herein can include a relatively low number of components. In comparison with the breaker of U.S. Pat. No. 5,589,673 in which two valves between the compression volume and the exhaust volume and at least one spring are used, only one valve need be used in a breaker as presently disclosed. A simplification of the design of the self-blowout circuit breaker can also be realized. For example, only one plate can be placed between the two volumes in the self-blowout circuit breaker disclosed herein whereas, in a circuit breaker according to U.S. Pat. No. 5,589,673, there is a complicated procedure in which the two valves are oriented in such a manner that an overlap exists, and the spring is placed and optionally prestressed.

Figure 1:
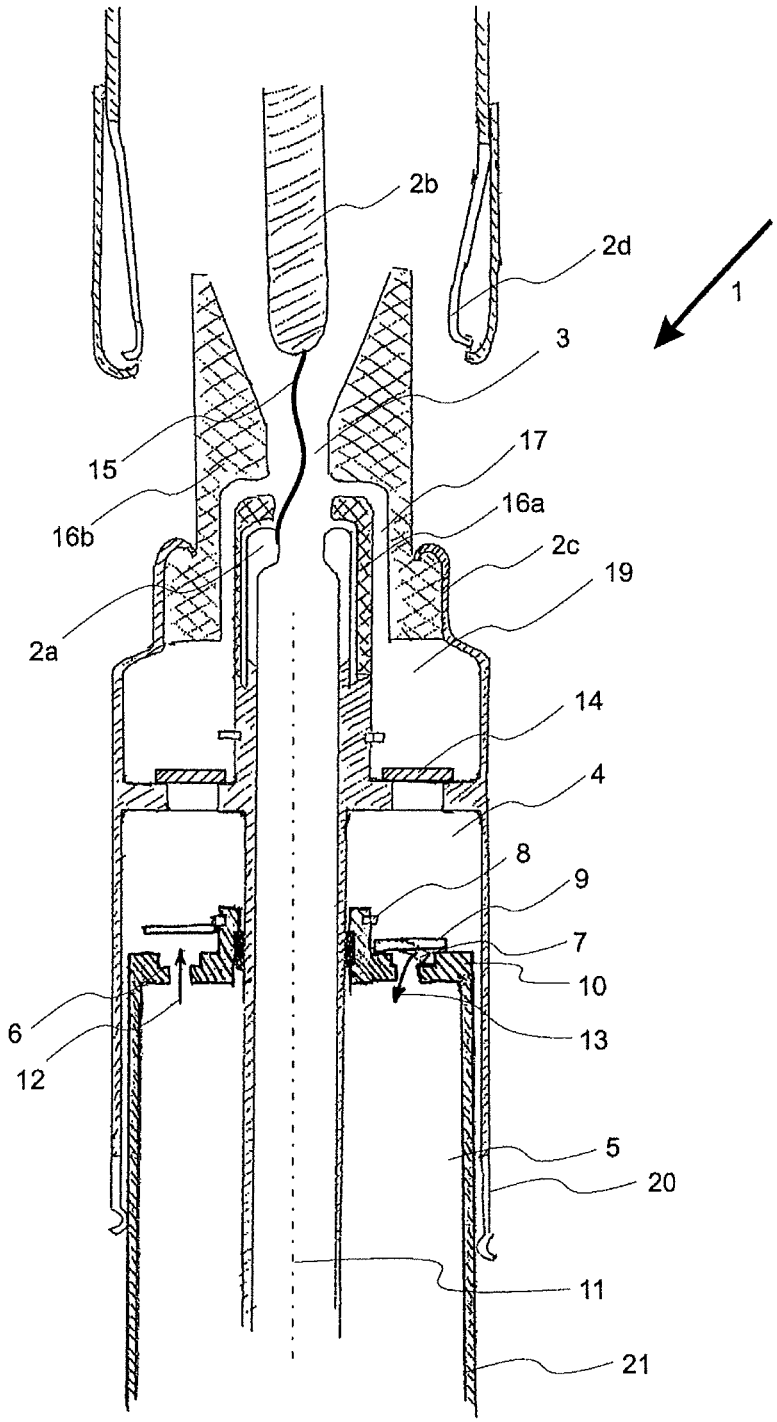
FIG. 1 shows a cross section along the longitudinal axis of an exemplary self-blowout circuit breaker as disclosed herein.

FIG. 1 shows a cross section along a longitudinal axis 11 of an exemplary self-blowout circuit breaker 1 as disclosed herein. A first operating state of the self-blowout circuit breaker 1 is illustrated to the left of the longitudinal axis 11 and a second operating state of the self-blowout circuit breaker 1 is illustrated to the right of the longitudinal axis 11, which states are referred to as filling operation and overpressure operation, respectively, below.

The self-blowout circuit breaker 1 has a first rated current contact 2*c* which can be moved in the direction of the longitudinal axis 11 of the self-blowout circuit breaker 1 in such a manner that it can come into contact with a second rated current contact 2*d*. The self-blowout circuit breaker 1 also has a first arcing contact 2*a* which can be moved in the direction of the longitudinal axis 11 of the self-blowout circuit breaker 1 in such a manner that it can come into contact with a second arcing contact 2*b*. In the event of the two arcing contacts 2*a*, 2*b* being disconnected, an arc 15 can be produced between these contacts. For disconnection of a power supply unit for example, the arc 15 can be weak on account of the relatively low current intensity. However, very high currents and therefore very strong arcs 15 can be produced in the event of a short circuit. These two possibilities are discussed in more detail in the further course of the description since they involve a separate procedure when quenching the arc 15.

The arc 15 can be quenched by blasting the arc 15 with a gas, such as $SF_6$ or other suitable means, which is inside an arc zone 3 and, when heated, flows toward the arc 15 from a heating volume 19 through a heating channel 17 into the arc zone 3. The heating channel 17 can be formed between an auxiliary nozzle 16*a* and a main nozzle 16*b*.

The heating volume 19 is separated from a compression volume 4 by at least one non-return valve 14 which is, for example, annular. The compression volume 4 is in turn separated from an exhaust volume 5 by a filling and overpressure valve 9. The filling and overpressure valve 9 is in the form of at least one plate, such as in the form of an annular disk which is arranged around the longitudinal axis 11 of the self-blowout circuit breaker 1, and can include (e.g., consists of) an elastic material, such as spring steel. It is, for example, arranged such that it lies on and is moveable on a carrier plate 10.

The filling and overpressure valve 9 is provided with at least one tab 7 which is cut into the valve 9, at least in parts, over the entire thickness of the filling and overpressure valve. As a result and also due to the filling and overpressure valve 9 consisting of the elastic material, the tab 7 can be deflected in a resilient manner essentially in the direction of the longitudinal axis 11 of the self-blowout circuit breaker 1 according to the disclosure. The tab 7 can accordingly undergo either a first deflection in the direction of the exhaust volume 5 during overpressure operation or a second deflection in the direction of the compression volume 4 during filling operation.

The first deflection of the tab 7 is limited in the direction of the exhaust volume 5 (overpressure operation) in the event of a second flow 13 of the gas by a first limiter 6 which is arranged on the side facing the exhaust volume 5. The first limiter 6 is, for example, part of the carrier plate 10, thus saving an independent component. However, it may also be arranged in its position in a movable manner relative to the tab 7. Its position determines the maximum first deflection of the tab 7.

An exemplary advantage of a first limiter 6 is, on the one hand, the avoidance of a first deflection into a region of plastic deformation of the tab 7, as a result of which the filling and overpressure valve 9 would become unusable, and, on the other hand, the possibility of setting a maximum amplitude of the first deflection.

A second limiter 8 for limiting a distance between the filling and overpressure valve 9 and the carrier plate 10 during a first flow 12 (during filling operation) can be provided and can be arranged, for example, on that side of the filling and overpressure valve 9 which faces the compression volume 4. Like in the case of the first limiter 6 as well, the second limiter 8 can, for example, be part of the carrier plate 10, thus saving a further independent component. However, the second limiter 8 can also be arranged moveably in its position relative to the tab 7. The position of the second limiter 8 determines the maximum distance by which the filling and overpressure valve 9 can be raised from the carrier plate 10.

An exemplary self-blowout circuit breaker 1 as disclosed herein can comprise a lower element 21 and an upper element 20. In the exemplary embodiment shown, the upper element 20 is arranged such that it can be displaced in the direction of the longitudinal axis 11 and the lower element 21 is fixed. If the first arcing contact 2*a* is disconnected from the second arcing contact 2*b*, the upper element 20, to which the first arcing contact 2*a* is fitted, is displaced in the direction away from the second arcing contact 2*b*.

Figure 2:
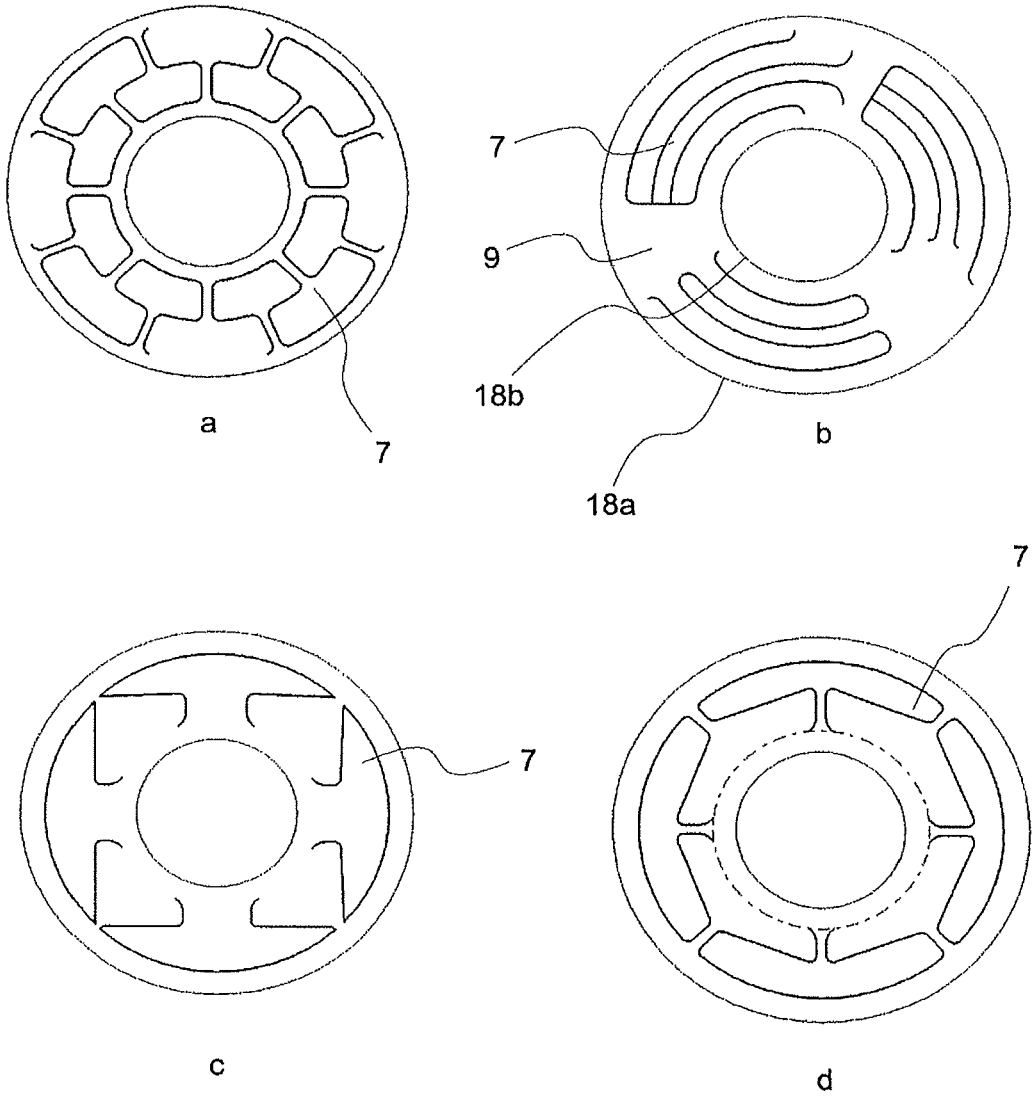
FIG. 2 shows a plan view of exemplary embodiments of a filling and overpressure valve with differently shaped tabs.

FIG. 2 shows, in FIGS. 2*a* to 2*d*, different exemplary embodiments of the filling and overpressure valve 9. In these examples, the filling and overpressure valves 9 are in the form of an annular disk with an outer edge 18*a* and an inner edge 18*b*. The shapes which result from the lines illustrated inside the edges 18*a*, 18*b* correspond to a plurality of tabs 7. The at least one tab 7 is, for example, cut into the annular disk over the entire thickness of the annular disk. The lines illustrate the cuts into the material of the annular disk.

The filling and overpressure valve 9 can be configured in such a manner that, in the case of a minimum gas pressure in the compression volume 4, the at least one tab 7 can be deflected such that it uncovers an opening for gas flowing through, in this case in the second throughflow direction 13 from the compression volume 4 into the exhaust volume 5.

The filling and overpressure valve 9 can be replaced with a different filling and overpressure valve of a different thickness and with differently shaped tabs. This allows a self-blowout circuit breaker 1 as disclosed herein to be adapted to parameters which are explained below. These parameters are, for example, the gas throughflow amount and the minimum gas pressure.

The shapes of the tabs 7 are associated with the desired maximum gas throughflow amount in the case of the second flow 13. As can be seen from FIG. 2, the circumference of the cuts which form the tabs 7 determines the openable area of the at least one tab 7. In other words, for a given gas pressure, the gas throughflow amount per unit time can be varied by selecting the circumference of the tab cuts or by selecting the size of the openable area.

If the thickness of the filling and overpressure valve 9 is varied, the spring constant of the tab 7 changes, the tab 7 for example having the same thickness as the plate of the filling and overpressure valve 9 or possibly having a thickness which differs from the thickness of the plate. A thicker tab 7 causes a higher spring constant or elastic restoring force, and a thinner tab 7 causes a lower spring constant or elastic restoring force. The spring constant or thickness of the tab 7 can be decisive, together with the length of the tab or opening area, for the time or response pressure or minimum gas pressure for opening the filling and overpressure valve 9. In the case of a higher spring constant, a higher minimum gas pressure is needed to deflect the tab 7. A lower minimum gas pressure is accordingly involved in the case of a lower spring constant. The thickness of the filling and overpressure valve is therefore a variable which can be used to set the desired minimum gas pressure for opening the valve 9 in the case of the second flow 13.

An elastic restoring force or spring constant can therefore be set by selecting an elasticity and/or shape of the at least one tab 7 in accordance with a predefinable minimum gas pressure for opening the tab 7, and an openable area of the at least one tab 7 can be selected in accordance with a predefinable gas throughflow amount. The maximum gas throughflow amount and the minimum gas pressure for the occurrence of the second flow 13 in the self-blowout circuit breaker 1 can therefore also be set in the simplest manner by replacing differently shaped filling and overpressure valves 9.

The self-blowout circuit breaker 1 can be designed for use as an outdoor switch or as a metal-encapsulated switch.

In another exemplary embodiment of a filling and overpressure valve 9 for use in the self-blowout circuit breaker 1, the valve plate, such as an annular disk in this case, has at least one tab 7 which is in the form of an annulus segment with respect to the center point of the valve plate or annular disk having one radial side and two concentric sides cut into the valve plate or annular disk.

Figure 3:
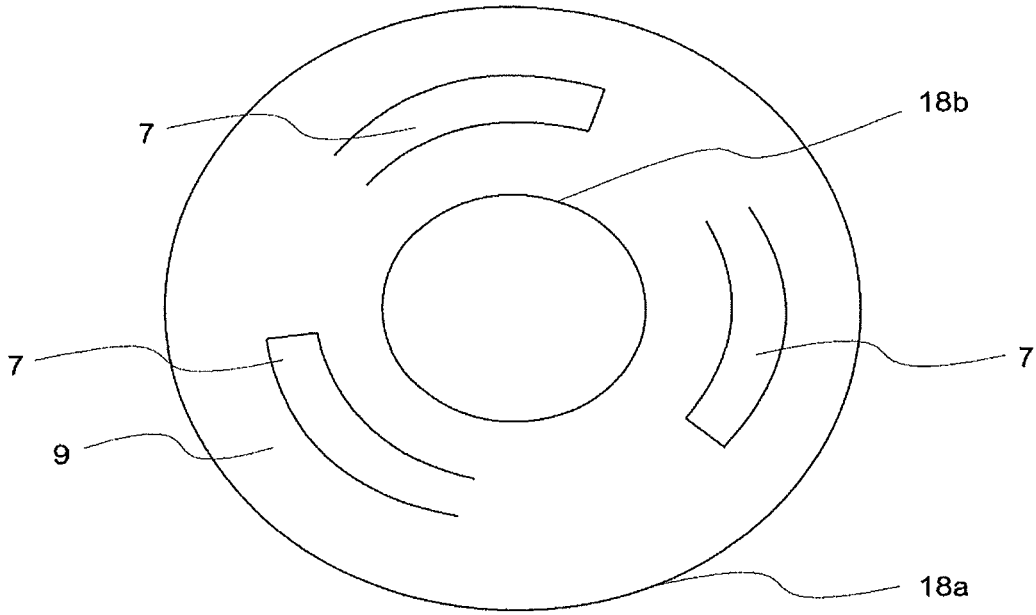
FIG. 3 shows a plan view of an exemplary embodiment of a filling and overpressure valve.

In the exemplary embodiment according to FIG. 3, the annular disk has, for example, three such tabs 7.

In another exemplary embodiment of the filling and overpressure valve 9, the annular disk can have an even number of tabs 7, such as two (or more) tabs 7, which are likewise in the form of annular (i.e., annulus) segments with respect to the center point of the annular disk having one radial side and two concentric sides cut into the annular disk, as explained above. Two of the tabs are in each case arranged in a mirror-inverted manner to one another with respect to a diameter line of the annular disk.

Figure 4:
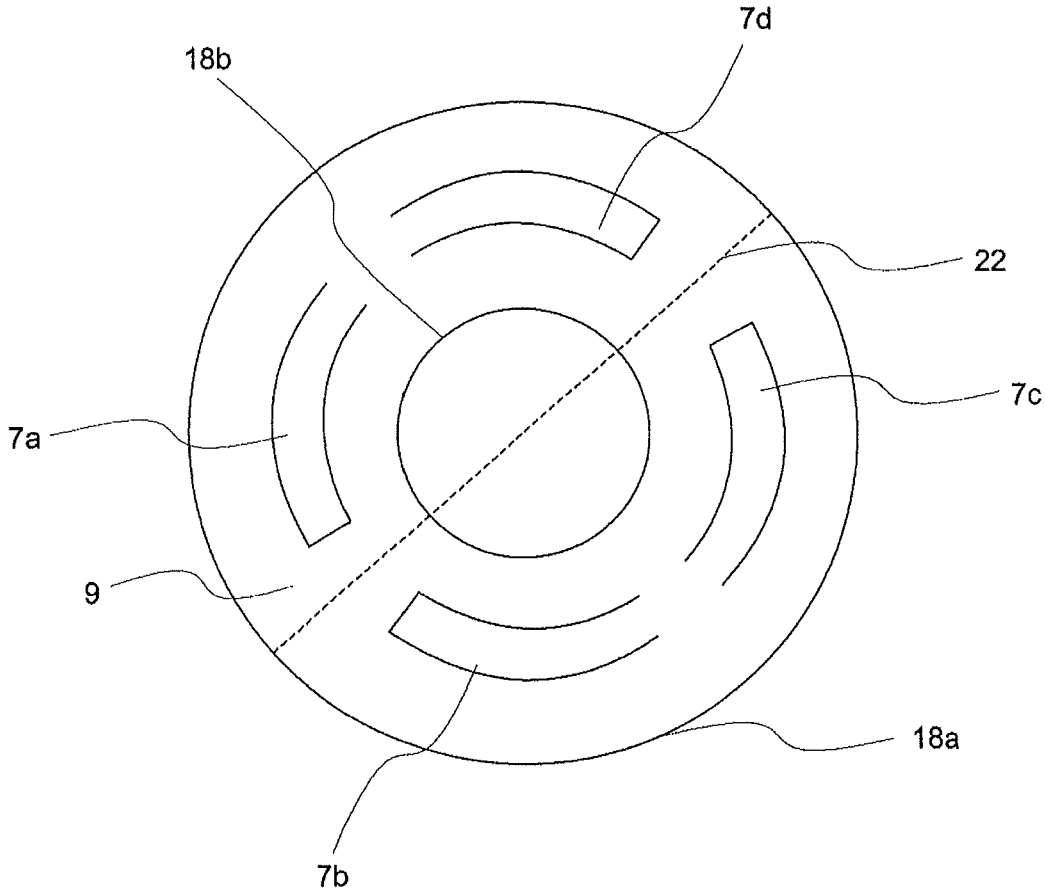
FIG. 4 shows a plan view of another exemplary embodiment of a filling and overpressure valve.

This embodiment is illustrated in FIG. 4 using the example of an annular disk having four tabs 7*a*, 7*b*, 7*c*, 7*d*, a first tab and a second tab 7*a*, 7*b* and a third tab and a fourth tab 7*c*, 7*d* each being arranged in a mirror-inverted manner to one another with respect to the diameter line 22 of the annular disk. This embodiment of the filling and overpressure valve 9 prevents, for example, a propeller effect which could arise if all tabs were oriented in the clockwise direction or anticlockwise direction. In other words, the opposed orientation of in each case two tabs prevents the annular disk from being able to be rotated by the gas flow when opening the filling and overpressure valve 9.

It goes without saying that an uneven number of tabs can also be selected depending on the dimensioning of the self-blowout circuit breaker 1 as disclosed herein. For example, an annular disk according to FIG. 3 could also have two tabs which are arranged in opposition, in which case the orientation of the tab which has not been assigned would not play a role since frictional forces would sufficiently counteract a remaining tendency of the annular disk to rotate.

The method of operation of the filling and overpressure valve 9 is explained below with the aid of the structural features of the self-blowout circuit breaker 1 disclosed herein which have already been described.

The filling and overpressure valve 9 can be configured in such a manner that it can be moved in the direction of flow in the case of the first flow 12 of the gas from the exhaust volume 5 into the compression volume 4, and that it is pressed onto a carrier plate 10 in the case of the second flow 13 of the gas from the compression volume 4 into the exhaust volume 5. In the second case, the at least one tab 7 undergoes the first resilient deflection in the direction of the exhaust volume 5 as a result of the gas pressure acting on it, such that the gas flows into the exhaust volume 5 (overpressure operation).

When the self-blowout circuit breaker 1 is closed, a current flows via the first and second rated current contacts 2*c*, 2*d* which are in contact in this case. The arcing contacts 2*a*, 2*b* are also in contact in this case.

Before a switching operation, all volumes can be filled with the gas at the same pressure. Pressure differences and gas flows, for example the first and second flows 12 and 13, are produced only by the switching operation, that is to say when disconnecting the circuit for example.

When disconnecting the circuit, i.e. when the upper element 20 moves away from the second arcing contact 2*b* in the direction of the longitudinal axis 11, the rated current contacts 2*c*, 2*d* are first of all disconnected, such that the current now only flows via the arcing contacts 2*a*, 2*b* which are still in contact. As the upper element 20 continues to move, the arcing contacts 2*a*, 2*b* are now also disconnected and the arc 15 is produced. The arc 15 is extended as the upper element 20 continues to move. As described above, the upper element 20 is displaced in the direction of the stationary lower element 21 when the arcing contacts 2*a*, 2*b* are being disconnected. As a result, the gas pressure in the compression volume 4 increases. As soon as said pressure is higher than in the heating volume 19, gas flows from the compression volume 4 through the non-return valve 14 into the heating volume 19, such that the gas pressure in the heating volume also increases.

Even in the case of weak arcs 15, for example if nominal operating currents are interrupted, the gas volume increases as soon as the gas in the arc zone 3 is essentially heated by an arc 15 which is produced when the arcing contacts 2*a*, 2*b* are disconnected during operation. However, in the case of weak arcs 15, hence in the case of weak currents to be interrupted, the gas pressure in the arc zone 3 remains lower than the gas pressure in the heating volume 19. The gas therefore always flows in this case from the compression volume 4 into the heating volume 19 and through the heating channel 17 into the arc zone 3 where the arc 15 is blown out at the current zero crossing.

In the case of strong arcs 15 which can be produced on account of a short circuit, for example, the gas in the arc zone 3 heats up quickly on account of the high current intensity of the arc 15, such that a large pressure increase also occurs in the heating volume 19. The pressure in the arc zone falls quickly at the zero crossing of the current, as a result of which a pressure gradient is produced between the arc zone 3 and the heating volume 19. As a result, gas flows from the heating volume 19 through the heating channel 17 back into the arc zone 3, such that the arc 15 is intensively blasted and quenched. On account of the large pressure increase in the heating volume 19 which exceeds the gas pressure in the compression volume 4, the non-return valve 14 closes and no further gas flows from the compression volume 4 into the heating volume 19. During the downward movement of the upper element 20, the pressure in the compression volume 4 continues to increase until the gas opens the overpressure valve of static design as disclosed herein upon reaching a particular differential pressure threshold value or minimum gas pressure and can flow into the exhaust volume 5. This is because, from this minimum gas pressure, the tab 7 is deflected in a resilient manner in the direction of the exhaust volume 5, such that it opens the filling and overpressure valve 9 and the second flow 13 is produced. As a result, the maximum pressure in the compression volume 4 and also the compression work to be carried out by the drive are limited. In the right-hand half of FIG. 1, this represents, during overpressure operation, the overpressure function of the filling and overpressure valve 9. As soon as the pressure in the compression volume 4 has fallen below a particular value again, the tab 7 returns to its closing initial position.

Upon closing the arcing contacts 2*a*, 2*b*, the upper element 20 is moved in the direction of the second arcing contact 2*b*. This produces a negative pressure or underpressure in the compression volume 4 in comparison with the exhaust volume 5. This results in the filling and overpressure valve 9 lifting off from the carrier plate 10 and fresh gas flowing into the compression volume 4. In other words, the first flow 12 is produced in this case. In the left-hand half of FIG. 1, this represents, during filling operation, the filling functionality of the filling and overpressure valve 9.

In another exemplary embodiment, the filling and overpressure valve 9 can be configured in such a manner that the abovementioned at least one tab 7 also comprises at least one further tab 7 which, in the case of a first flow 12 of the gas from the exhaust volume 5 into the compression volume 4, i.e. during filling operation, undergoes a second resilient deflection in the direction of the compression volume 4 as a result of the gas pressure acting on it, i.e. the filling pressure, such that the gas flows into the compression volume 4. Such a filling and overpressure valve 9 having at least one overpressure tab 7 for relieving overpressure, here for the compression volume 4 by the second flow 13 of the gas from the compression volume 4 into the exhaust volume 5, and having at least one additional filling pressure tab 7, here for filling the compression volume 4 with gas when opening the contacts by the first flow of the gas from the exhaust volume 5 into the compression volume 4, can be completely static, i.e. mounted in a fixed manner. Elasticity and/or shape can each be selected separately for the at least one overpressure tab 7 and the at least one filling pressure tab 7 or can even be individually selected for each tab 7 in accordance with a predefinable minimum gas pressure, here the overpressure threshold value for the overpressure tab 7 or the filling pressure threshold value for the filling pressure tab 7, for opening the tab 7, and an openable area can be selected in accordance with a predefinable gas throughflow amount. A limiter for limiting the second resilient deflection of the at least one filling pressure tab 7 can likewise be arranged on that side of the tab 7 which faces the compression volume 4 and may, for example, be part of the carrier plate 10.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1=Self-blowout circuit breaker, self-extinguishing circuit breaker
2*a*=First arcing contact
2*b*=Second arcing contact
2*c*=First rated current contact
2*d*=Second rated current contact
3=Arc zone
4=Compression volume
5=Exhaust volume
6=First limiter
7, 7*a*-7*d*=Tabs, overpressure opening tabs
8=Second limiter
9=Filling and overpressure valve
10=Carrier plate
11=Longitudinal axis of the self-blowout circuit breaker
12=First flow
13=Second flow
14=Non-return valve
15=Arc
16*a*=Auxiliary nozzle
16*b*=Main nozzle
17=Heating channel in the arc zone
18*a*=Outer edge
18*b*=Inner edge
19=Heating volume
20=Upper element
21=Lower element
22=Diameter line

What is claimed is:

1. A self-blowout circuit breaker having contacts for connecting or disconnecting a circuit, the self-blowout circuit breaker comprising:

at least one first arcing contact and one first rated current contact moveable back and forth in a direction of a longitudinal axis of the self-blowout circuit breaker;

a compression volume which is connected to a heating volume by at least one non-return valve, wherein the heating volume is connected to an arc zone, such that when the first arcing contact is being disconnected from at least one associated second arcing contact, an arc is produced between the first and second arcing contacts in the arc zone;

an exhaust volume, wherein the compression volume and the exhaust volume are filled with a gas; and a combined filling and overpressure valve that separates the compression volume from the exhaust volume, wherein the valve is an annular disk formed by at least one plate having at least one tab formed in the plate, and arranged around the longitudinal axis of the self-blowout circuit breaker.

2. The self-blowout circuit breaker according to claim 1, wherein the combined filling and overpressure valve is configured to be moveable in a direction of a first flow of gas from the exhaust volume into the compression volume.

3. The self-blowout circuit breaker according to claim 2, wherein the combined filling and overpressure valve is configured to be pressed onto a carrier plate when a second flow of the gas occurs from the compression volume into the exhaust volume, and the at least one tab undergoes a first resilient deflection in a direction of the exhaust volume as a result of gas pressure acting on it, such that the gas flows into the exhaust volume.

4. The self-blowout circuit breaker according to claim 3, comprising:

a first limiter, for limiting the first resilient deflection of the at least one tab, arranged on a side of the tab which faces the exhaust volume, the first limiter being part of the carrier plate.

5. The self-blowout circuit breaker according to claim 4, comprising:

a second limiter, for limiting a distance of the filling and overpressure valve from the carrier plate during the first flow, arranged on a side of the filling and overpressure valve which faces the compression volume, the second limiter being part of the carrier plate.

6. The self-blowout circuit breaker according to claim 1, wherein the annular disk includes at least three tabs, formed as annulus segments with respect to a center point of the annular disk, having one radial side and two concentric sides cut into the annular disk.

7. The self-blowout circuit breaker according to claim 1, wherein the annular disk has plural tabs formed as annulus segments with respect to a center point of the annular disk, having one radial side and two concentric sides cut into the annular disk, two of the tabs in each case being arranged in a mirror-inverted manner to one another with respect to a diameter line of the annular disk.

8. The self-blowout circuit breaker according to claim 1, wherein the combined filling and overpressure valve is exchangeable.

9. The self-blowout circuit breaker according to claim 1, wherein the combined filling and overpressure valve, consists entirely of an elastic material.

10. The self-blowout circuit breaker according to claim 1, in combination with an outdoor switch or a metal-encapsulated switch.

11. The self-blowout circuit breaker according to claim 1, wherein the combined filling and overpressure valve is configured such that a minimum gas pressure in the compression volume deflects the at least one tab to uncover an opening.

12. The self-blowout circuit breaker according to claim 1, wherein the at least one tab is formed with an elasticity and/or shape selected in accordance with a predefinable minimum gas pressure for opening the tab, and an openable area of the at least one tab is selected in accordance with a predefinable gas throughflow amount.

13. The self-blowout circuit breaker according to claim 1, wherein the combined filling and overpressure valve is configured such that the at least one tab comprises:

at least one overpressure tab for relieving overpressure in the compression volume; and at least one filling pressure tab for filling the compression volume with gas.

14. The self-blowout circuit breaker according to claim 1, wherein the filling and overpressure valve, consists entirely of a spring material.

* * * * *